United States Patent [19]

Brinkmeier

[11] 4,055,034

[45] Oct. 25, 1977

[54] APPARATUS FOR COMPRESSING AND PACKAGING STACKS OF FLAT SUPERPOSED SHEET ARTICLES

[75] Inventor: Friedhelm Brinkmeier, Ladbergen, Germany

[73] Assignee: Windmoller & Holscher, Westphalia, Germany

[21] Appl. No.: 766,182

[22] Filed: Feb. 7, 1977

[51] Int. Cl.[2] ..... B65B 63/02

[52] U.S. Cl. ..... 53/124 C

[58] Field of Search ..... 53/124 C, 124 D

[56] References Cited

U.S. PATENT DOCUMENTS

| | | | |
|---|---|---|---|
| 3,650,087 | 3/1972 | Brinkmeier et al. | 53/124 C |
| 3,747,295 | 7/1973 | Brinkmeier | 53/124 C |

*Primary Examiner*—Travis S. McGehee

*Attorney, Agent, or Firm*—Fleit & Jacobson

[57] ABSTRACT

Apparatus for compressing stacks of flat superposed sheet articles such as bags and enveloping the stacks in packaging film comprises a pressure chamber through an inlet aperture of which each stack is lifted by a pressure ram, together with a packaging film that initially spans the inlet aperture and comes to lie along the top and sides of the stack after the latter has been inserted in the pressure chamber. Following compression of the stack between the ram and a removable backing member at the top of the chamber, a reciprocatable push member having one end disposed adjacent the inlet aperture executes a forward stroke to cover the underside of the stack while the ram is laterally retracted, whereby the enveloped stack is supported by the push member on termination of its forward stroke. Welding means for joining the ends of the enveloping film cooperate with the push member, which comprises a frame and a plurality of parallel rollers freely rotatably mounted in said frame. Means for lowering the other end of the push member during or after its return stroke enable said push member additionally to act as a roller ramp for withdrawing the enveloped stack supported thereby.

6 Claims, 3 Drawing Figures

III
III
31
39
34
20
27
30
29
19
18
10
26.3
5
28
8
26
26.2
38.1
38.4
9
26.1
6.3
36
6
38.2
37
35
32
38.3
38
13
24
23
7

APPARATUS FOR COMPRESSING AND PACKAGING STACKS OF FLAT SUPERPOSED SHEET ARTICLES

The invention relates to an apparatus for compressing and packaging stacks of flat superposed sheet articles, particularly flattened bags or sacks.

In an apparatus of this kind known from DT-PS 2,034,696, the stacks are successively compressed in a pressure chamber in which they are introduced by a ram together with a film of packaging material that initially spans an inlet aperture for the stack and that therefore covers the top and two sides of the stack once the latter has been inserted in the chamber. Following compression by the ram, the film is also folded around the underside of the stack by means of a reciprocatable push member which, on a forward stroke, moves along the underside of the stack with its forward end whilst the pressure ram is being retracted. At the end of its forward stroke, the push member supports the enveloped stack and co-operates with welding means for joining the ends of the enveloping film. The push member comprises a frame and a plurality of parallel rollers freely rotatably mounted in said frame. Roller tracks are provided for alternately pressing on the rollers of the push member from above and below and imparting clockwise or anti-clockwise rotation to them during reciprocation of the push member. During the return stroke of the latter, i.e. during its movement away from the pressure chamber, the rollers roll on the roller tracks therebelow so that the compressed stack enveloped in a welded sleeve of packaging film has, by reason of the rolling motion of the rollers, additional movement imparted to it relatively to the frame of the push member and this additional motion moves the stack to a ramp for taking the stack away. Apart from the constructional measures that have to be taken to provide roller tracks for pressing against the rollers of the push member, it is quite possible that the stack remains to lie on the rollers after the push member has already completed its return stroke.

It is therefore an object of the present invention to provide an improved and simplified apparatus in which the enveloped stack removed from the pressure chamber is less likely to have its travel interrupted on the way to a conveyor or other means for taking each stack away.

Accordingly, the apparatus according to the invention for compressing and packaging stacks of flat superposed sheet articles comprises a pressure chamber having an inlet aperture, said stacks being successively insertable in said pressure chamber through said inlet aperture, a vertically reciprocatable pressure ram for lifting each stack into said pressure chamber and pressing same against a removable backing member at the top of said chamber, means for spanning packaging film across said inlet aperture whereby said film is carried into said pressure chamber together with each lifted stack to cover the top and two sides of the said stack, a transversely reciprocatable push member disposed with one end adjacent said inlet aperture of said pressure chamber for covering the underside of said stack with said film on a forward stroke, whereby to envelop said stack with said film, said ram being laterally retractable along said underside as said push member executes said forward stroke, whereby said enveloped stack is supported by said push member on termination of said forward stroke, welding means for joining the ends of said enveloping film to form a sleeve upon termination of said forward stroke, said push member comprising a frame and a plurality of parallel rollers freely rotatably mounted in said frame, and means for lowering the other end of said push member during or after its return stroke, whereby said push member additionally acts as a roller ramp for withdrawing the enveloped stack supported thereby.

By means of the invention, therefore, the push member is tilted during or after its return stroke by lowering its said other end and the packaged stack of sheet articles can run out of the pressure chamber under its own weight along the freely rotatable rollers of the push member. The roller ramp formed by the push member in its tilted position can be followed by a further fixed or movable slide or conveyor.

Preferably, the push member frame is reciprocatable in guides pivotable about a shaft extending transversely to the direction of reciprocation, a piston-cylinder unit pivotally connected between the frame and a stand of the apparatus being provided to reciprocate the push member. With this construction, the said other end of the push member can readily be swung downwards during the return stroke if that part of the push member projecting beyond the shaft is sufficiently heavy.

The frame of the push member may comprise parallel side members which support the rollers and be provided with teeth in mesh with spur gears that are fixed to the shaft, the latter being freely rotatable. The serrated side members running on the spur gears ensure good guiding of the push member during its reciprocation even if the piston-cylinder unit engages the push member off centre, for example if it engages one of the side members. The reciprocating force applied to only one of the side members is synchronously transmitted by the spur gears and the shaft to the other of the side members so that there will be little danger of the frame of the push member becoming twisted or becoming jammed in the pivotable guides.

The shaft carrying the spur gears may also serve as one of the rollers for supporting the packaging film.

In one form of the invention, the said one end of the push member rests on a fixed three-land control cam during insertion of the stack in the pressure chamber. A first land of the control cam is disposed at an elevation so that, when the push member is engaged therewith, a gap is left between the rollers of the push member and the underside of the stack. A second land is disposed so that, when the push member is engaged therewith, the tops of the rollers are flush with the top of the pressure ram. The third land is disposed so that, when the push member is engaged therewith, two of the rollers at said one end of the push member are pressed with the film against the aforementioned welding means. This manner of mounting and guiding the push member ensures that the latter can readily push the film under the lowermost article in the stack as the pressure ram is being retracted, without any danger of crumpling or folding over the corners of the lowermost article. When the push member is engaged with the second land, the rollers of the push member support the stack in the pressure chamber in the same way as was done by the receding pressure ram. Welding is initiated and performed when the push member is in engagement with the third land, it being unnecessary to impart any movement to the welding means.

Fixed further cam means may be provided to engage the other end of the push member during the end of its return stroke to lower said other end during the final stage of the return stroke. Since the push member will be tilted during its return stroke only if it moves in its guides in a direction opposite to the return stroke, the length of the push member projecting beyond the shaft about which the guides are pivoted may not always be sufficiently heavy to bring about the tilting movement and it is for that reason that the fixed further cam means are provided.

Further features of the invention will become evident from the following description of an example with reference to the accompanying drawings, wherein.

Figure 1:
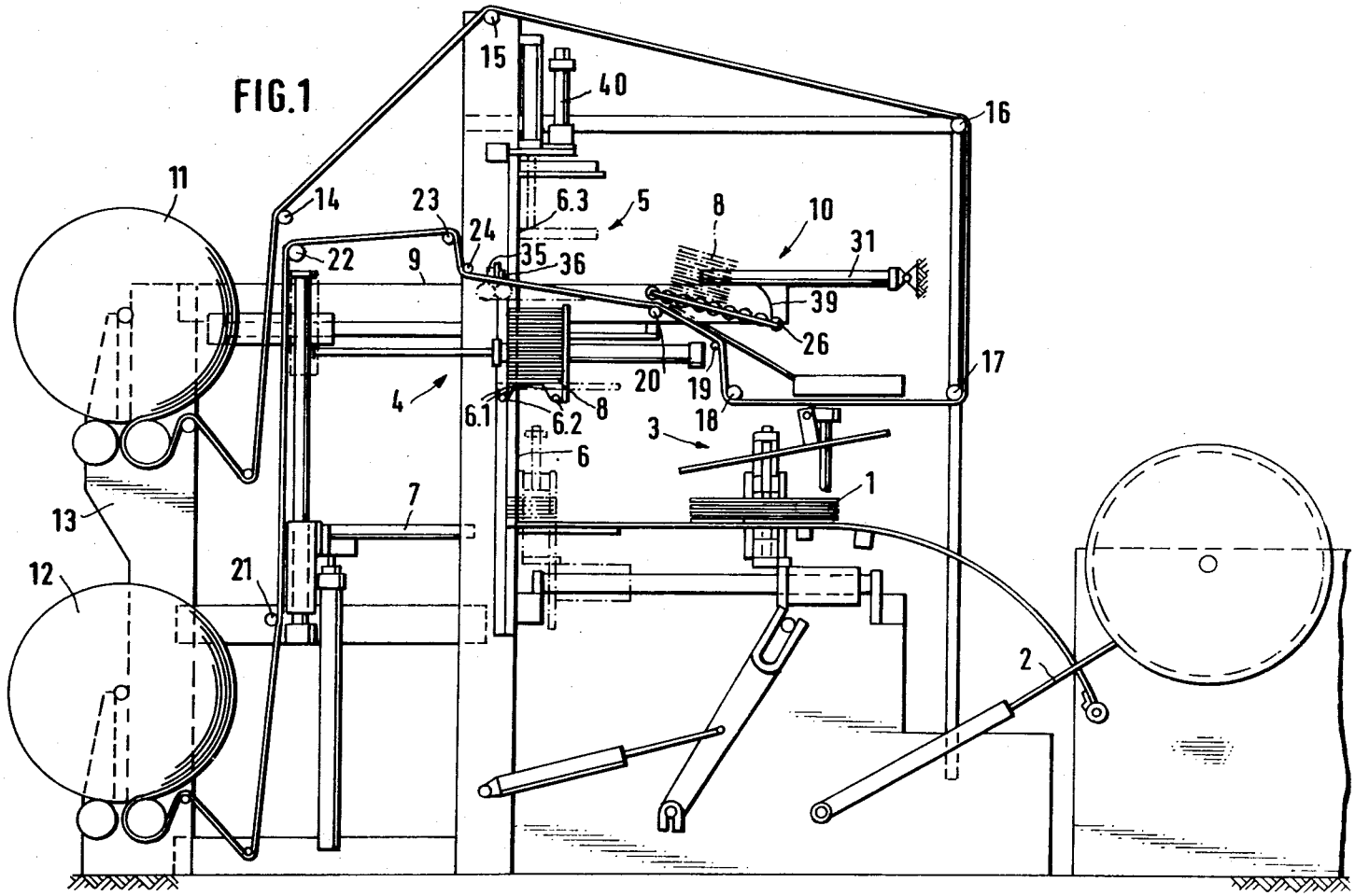
FIG. 1 is a diagrammatic elevation of a compressing and packaging apparatus.

Referring to FIG. 1, flattened bags from a bag-making machine (not shown) arrive on a rotary depositing cylinder from which they are successively removed by a gripper 2 and transferred to a compressing and packaging apparatus which comprises a pressing and turning station 3, a packet-forming station 4 and a packaging station 5. The gripper 2 takes the individually arriving bags and forms from them a stack 1. Successive such stacks are deposited in front of an abutment 6 and, whilst being removed from the pressing and turning station 3, successive stacks are alternately rotated in opposite directions through 90°. A pressure ram 7 then lifts the superposed stacks 1 to the packet-forming station 4, suitable openings being provided in the abutment 6 and a depositing table in front of the abutment to enable the ram 7 to move upwardly.

By means of the pressure ram 7, the individual stacks 1 are combined at the packet-forming station 4 to form a packet or larger stack 8. Upon delivery of the last individual stack 1, the larger stack 8 is lifted to a level 9 in a plane defined by the upper edge of the raised pressure ram 7 or by the upper edges of the rollers 26 of a folding tool 10. At the packaging station 5, the larger stack 8 is enveloped by a packaging film of which the ends are interconnected by welding. The packaging station 5 has an inlet aperture at the bottom and this inlet aperture is spanned by packaging film which is lifted together with the stack 8 as the latter is being raised by the ram 7. At the top of the packaging station there is a retractable backing member 40 which cooperates with the ram 7 to compress the stack 8. After a sleeve of the packaging film has been formed by welding the ends of the film together, the backing member is lifted from the stack 8 so that the enveloped stack can be removed from the packaging station.

The packaging film is unwound in known manner from supply reels 11, 12 that are rotatably mounted in a stand 13 of the apparatus and the film is led to the packaging station 5 over respective guide rollers 14 to 20 or 21 to 24. During insertion of the stack 8 in the packaging station 5 by means of the ram 7, the packaging film is wrapped around three sides of the stack. The folding tool 10 is inserted under the stack 8 from the right-hand side to wrap the film around the fourth side of the stack, namely the underside, whereupon the ends of the film are welded together in a manner to be described hereinafter. In FIG. 1, the folding tool or push member 10 is shown in a retracted position.

Figure 2:
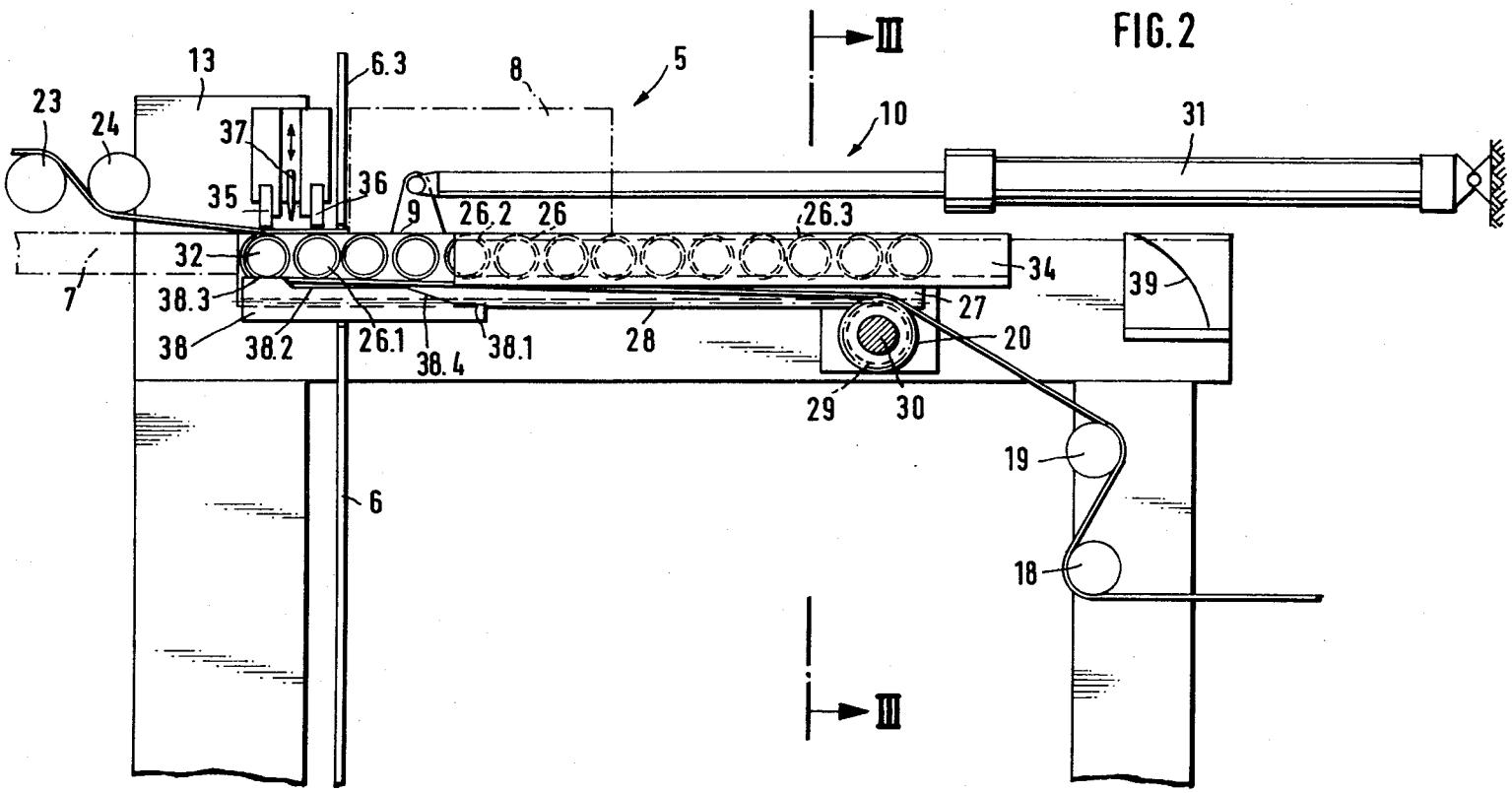
FIG. 2 is a side elevation of part of the FIG. 1 apparatus drawn to a larger scale.
Figure 3:
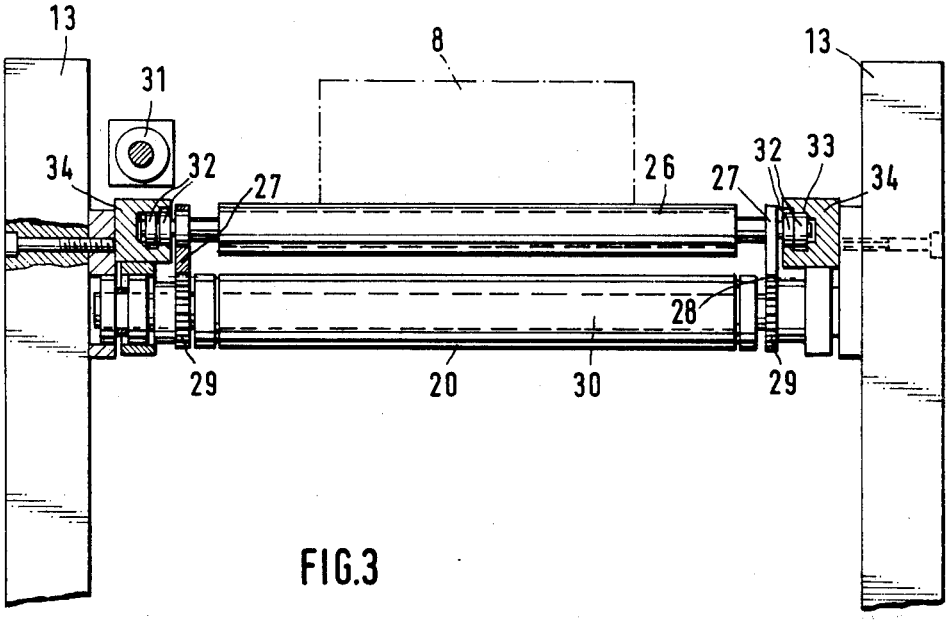
FIG. 3 is a section on the line III—III in FIG. 2.

Referring to FIGS. 2 and 3, these show the packaging station 5 to a larger scale. The push member 10 consists of rollers 26 of which the ends are freely rotatably mounted in respective parallel side members of a frame 27. The undersides of the side members of the frame 27 are provided with teeth 28 which engage spur gears 29. The spur gears 29 are fixed to a shaft 30 mounted in the stand 13 to extend transversely to the side members of the frame 27. The aforementioned guide roller 20 for the packaging film is freely rotatable on the shaft 30. One end of a pressure-cylinder unit 31 is hinged to the stand 13 and its other end is pivoted to one of the side members of the frame 27. The ends of three of the rollers 26, namely the rollers 26.1, 26.2 and 26.3 carry freely rotatable guide rollers 32 which run in guide grooves 33 of guide members 34. The guide members 34 are pivotable on the shaft 30 and have substantially the same length as the side members of the frame 27. By means of the pressure-cylinder unit 31, the push member 10 comprising the frame 27 and rollers 26 can be reciprocated along the guide members 34. At the end of the forward stroke of the frame 27, about half the length of the frame 27 projects beyond the front end of the guides 34 and at the end of its return stroke about half its length projects beyond the rear end of the guides 34 because the stroke of the frame 27 is about twice as long as the length of the frame. During folding of the film, the frame 27 reaches the underside of the stack 8 that has been lifted into the packaging station 5. The foremost roller 26 folds the packaging film onto the underside of the stack 8. During the forward stroke of the frame 27, the pressure ram 7 is synchronously horizontally retracted in known manner.

Above the first and second rollers 26, 26.1 of the frame 27 when the latter is at the end of its forward stroke, welding bars 35, 36 are fixed to the stand 13 or to an extension 6.3 of the abutment 6, the welding bars extending lengthwise of the rollers and parallel thereto. A verticlly reciprocatable severing knife 37 for transversely cutting the packaging film is mounted between the two welding bars 35, 36. Beneath the frame 27 there is a three-land control cam 38, the lands being indicated at 38.1, 38.2 and 38.3. The lands 38.1 and 38.2 are joined by an oblique cam surface 38.4. During the first phase of folding the packaging film under the stack 8, the frame 27 of the push member rests on the land 38.1. The frame is thereby inclined and the rollers 26 run beneath the stack 8 that is being held in the packaging station 5 by means of the pressure ram 7. The inclined surface 38.4 enables the frame 27 to be lifted to the land 38.2 during its forward stroke. The guide rollers 32 roll on this land 38.2 and during this time the rollers 26 assume a horizontal position flush with the upper edge of the pressure ram 7. Just before the frame 27 reaches the end of its forward stroke, the guide roller 32 of the foremost roller 26 runs onto the narrow land 38.3 of the control cam, whereby the foremost roller is lifted by about 2 mm so that the foremost roller 26 and the roller 26.1 next to it lie against the respective welding bars 35, 36. This initiates welding of the run of the packaging film passing about the foremost roller 26 to the run of packaging film withdrawn from the supply reel 11. Simultaneously, the length of packaging film stretched between the welding bars 35, 36 and the two foremost rollers 26 is severed by the knife 37, which is lowered for that purpose.

At the rear end of the roller guide 34, a control cam 39 is fixed to the stand 13 and is of substantially arcuate shape. The guide roller 32 of the roller 26.3 runs up against the control cam 39. This gives rise to a force that is exerted on the rear end of the frame 27 and causes the rear end of the roller guide 34 to tilt downwardly about the shaft 30 during the final stage of the return stroke of the frame 27 if the frame 27 or guide 34 have not already been tilted under their own weight. The packaged stack 8 can now automatically slide or roll along the push member to reach a further slide or conveyor for taking the stack away.

I claim:

1. Apparatus for compressing and packaging stacks of flat superposed sheet articles, comprising a pressure chamber having an inlet aperture, said stacks being successively insertable in said pressure chamber through said inlet aperture, a vertically reciprocatable pressure ram for lifting each stack into said pressure chamber and pressing same against a removable backing member at the top of said chamber, means for spanning packaging film across said inlet aperture whereby said film is carried into said pressure chamber together with each lifted stack to cover the top and two sides of said stack, a transversely reciprocatable push member disposed with one end adjacent said inlet aperture of said pressure chamber for covering the underside of said stack with said film on a forward stroke, whereby to envelop said stack with said film, said ram being laterally retractable along said underside as said push member executes said forward stroke, whereby said enveloped stack is supported by said push member on termination of said forward stroke, welding means for joining the ends of said enveloping film to form a sleeve upon termination of said forward stroke, said push member comprising a frame and a plurality of parallel rollers freely rotatably mounted in said frame, and means for lowering the other end of said push member during or after its return stroke, whereby said push member additionally acts as a roller ramp for withdrawing the enveloped stack supported thereby.

2. The apparatus as defined in claim 1, wherein said push member frame is reciprocatable in guides pivotable about shaft extending transversely to the direction of reciprocation.

3. The apparatus defined in claim 2, wherein said frame comprises parallel side members which support said rollers, said shaft is freely rotatable and carries fixed spur gears, and said side members are provided with teeth in mesh with said spur gears.

4. The apparatus defined in claim 1 including a piston-cylinder unit for reciprocating said push member, said unit being pivotally connected between said frame and a stand of the apparatus.

5. The apparatus defined in claim 1 including a fixed three-land control cam co-operating with said one end of said push member, wherein a first land of said control cam is disposed at an elevation so that, when said push member is engaged therewith, a gap is left between said rollers and the underside of said stack, a second land is disposed so that, when said push member is engaged therewith, the tops of said rollers are flush with the top of said ram, and a third land is disposed so that, when said push member is engaged therewith, two of said rollers at said one end of said push member are pressed with said film against said welding means.

6. The apparatus defined in claim 1 including fixed cam means engaging said other end of said push member during the end of said return stroke whereby to lower said other end.

* * * * *